US011930904B1

(12) United States Patent
Gaudioso

(10) Patent No.: US 11,930,904 B1
(45) Date of Patent: Mar. 19, 2024

(54) PORTABLE STORAGE DEVICES AND METHODS OF USING THE SAME

(71) Applicant: Vincent Gaudioso, Boca Raton, FL (US)

(72) Inventor: Vincent Gaudioso, Boca Raton, FL (US)

( * ) Notice: Subject to any disclaimer, the term of this patent is extended or adjusted under 35 U.S.C. 154(b) by 0 days.

(21) Appl. No.: 17/949,560

(22) Filed: Sep. 21, 2022

Related U.S. Application Data

(60) Provisional application No. 63/261,451, filed on Sep. 21, 2021.

(51) Int. Cl.

| | |
|---|---|
| ***A45C 11/24*** | (2006.01) |
| ***A45C 13/02*** | (2006.01) |
| ***B65D 25/04*** | (2006.01) |
| ***B65D 25/22*** | (2006.01) |
| ***B65D 25/54*** | (2006.01) |
| *A45C 11/00* | (2006.01) |

(52) U.S. Cl.
CPC ..... *A45C 11/24* (2013.01); *A45C 13/02* (2013.01); *B65D 25/04* (2013.01); *B65D 25/22* (2013.01); *B65D 25/54* (2013.01); *A45C 2011/001* (2013.01); *A45C 2011/002* (2013.01); *A45C 2011/003* (2013.01); *A45C 2200/20* (2013.01)

(58) Field of Classification Search
CPC ... B65D 25/22; B65D 25/54; A45C 2011/001; A45C 2011/002; A45C 2011/003; A45C 2200/20
USPC ..... 248/312, 312.1; 206/547, 579
See application file for complete search history.

(56) References Cited

U.S. PATENT DOCUMENTS

| | | | | |
|---|---|---|---|---|
| 7,040,681 | B1 * | 5/2006 | Broberg | B25H 3/04 294/146 |
| 7,464,907 | B1 * | 12/2008 | Lane | A47K 1/09 248/312.1 |
| 9,004,283 | B1 * | 4/2015 | Lozano | A63B 57/207 206/315.1 |
| 2008/0265118 | A1 * | 10/2008 | Cicero | A47K 3/281 248/312 |
| 2009/0014617 | A1 * | 1/2009 | Cicero | A47B 73/00 248/312 |
| 2009/0236254 | A1 * | 9/2009 | Jenkins | B65D 25/22 206/459.5 |
| 2010/0012807 | A1 * | 1/2010 | Perman | A45F 5/02 248/312 |
| 2022/0407553 | A1 * | 12/2022 | Phelan | H04B 1/3877 |

* cited by examiner

*Primary Examiner* — Jacob K Ackun
(74) *Attorney, Agent, or Firm* — Downs Rachlin Martin PLLC

(57) ABSTRACT

Portable storage devices configured to organize and store personal items so that the items can be quickly and easily transported from one location to another, such as during a workout at a gym. In some examples the storage devices may include an attachment feature for securing the storage device to another structure at an above-ground location.

13 Claims, 10 Drawing Sheets

PORTABLE STORAGE DEVICES AND METHODS OF USING THE SAME

RELATED APPLICATION DATA

This application claims the benefit of priority of U.S. Provisional Patent Application Ser. No. 63/261,451, filed Sep. 21, 2021, and titled "Portable Storage Devices And Methods Of Using The Same," which is incorporated by reference herein in its entirety.

FIELD OF THE DISCLOSURE

The present disclosure generally relates to the field of physical storage device for the storage of physical objects. In particular, the present disclosure is directed to portable storage devices and methods of using the same.

BACKGROUND

When exercising at a gym a person may have multiple items that he may want to carry with him during a workout rather than storing in a locker room, such as a mobile electronic device (e.g., mobile phone, tablet, music player, etc.), water bottle, headphones (e.g. ear buds), keys, towel, wallet, etc. The person often needs to repeatedly place her belongings on the floor of the gym and then collect all of the items to move them to another location as she proceeds through her workout.

SUMMARY OF THE DISCLOSURE

In one implementation, the present disclosure is directed to a portable storage device. The portable storage device includes a housing that includes: a first storage compartment capable of holding a mobile electronic device; a bottle holder located below the first storage compartment for hanging a water bottle from the storage device by a neck of the water bottle, the bottle holder including a surface configured to support the water bottle and an opening in the surface configured to receive a neck of the bottle; and an attachment disposed on the housing for removeably coupling the storage device to a structure.

In another implementation, the present disclosure is directed to a portable storage device. The portable storage device includes a housing; a retractable elongate member slidably disposed in the housing and configured to move between a retracted position in which the elongate member is disposed in the housing and an extended position in which a portion of the elongate member extends from the housing to provide a structure for hanging a towel or other object from the storage device; a bottle holder located in a bottom portion of the housing for hanging a bottle from the storage device by a neck of the bottle, the bottle holder including a surface configured to support the bottle and an opening in the surface configured to receive a neck of the bottle; and an attachment disposed on the housing for removeably coupling the storage device to a structure.

In yet another implementation, the present disclosure is directed to a method of using a portable storage device that includes a housing and a bottle holder. The method includes removeably attaching the portable storage device to a structure at an above ground elevated location on the structure; and hanging a water bottle from the storage device by sliding a finish portion of the water bottle into a finish opening located on a front wall of the housing and hanging the water bottle from a bottle support wall of the housing that is transverse to the front wall.

BRIEF DESCRIPTION OF THE DRAWINGS

For the purpose of illustrating the disclosure, the drawings show aspects of one or more embodiments of the disclosure. However, it should be understood that the present disclosure is not limited to the precise arrangements and instrumentalities shown in the drawings, wherein.

DETAILED DESCRIPTION

Aspects of the present disclosure include portable storage devices configured to organize and store personal items, such as one or more of a mobile electronic device, water bottle, headphones (e.g. ear buds), keys, towel, wallet, etc. so that the collection of items can be quickly and easily transported from one location to another, such as during a workout at a gym. In some examples the storage devices may include an attachment feature for securing the storage device to another structure at an above-ground location. By way of example, the storage device may include a magnet for quickly and easily attaching the storage device to any magnetically compatible material, such as the metal frame of a piece of exercise equipment, to securely and temporarily store a collection of personal items at an above-ground location in a gym while the person performs an exercise routine.

Figure 1:
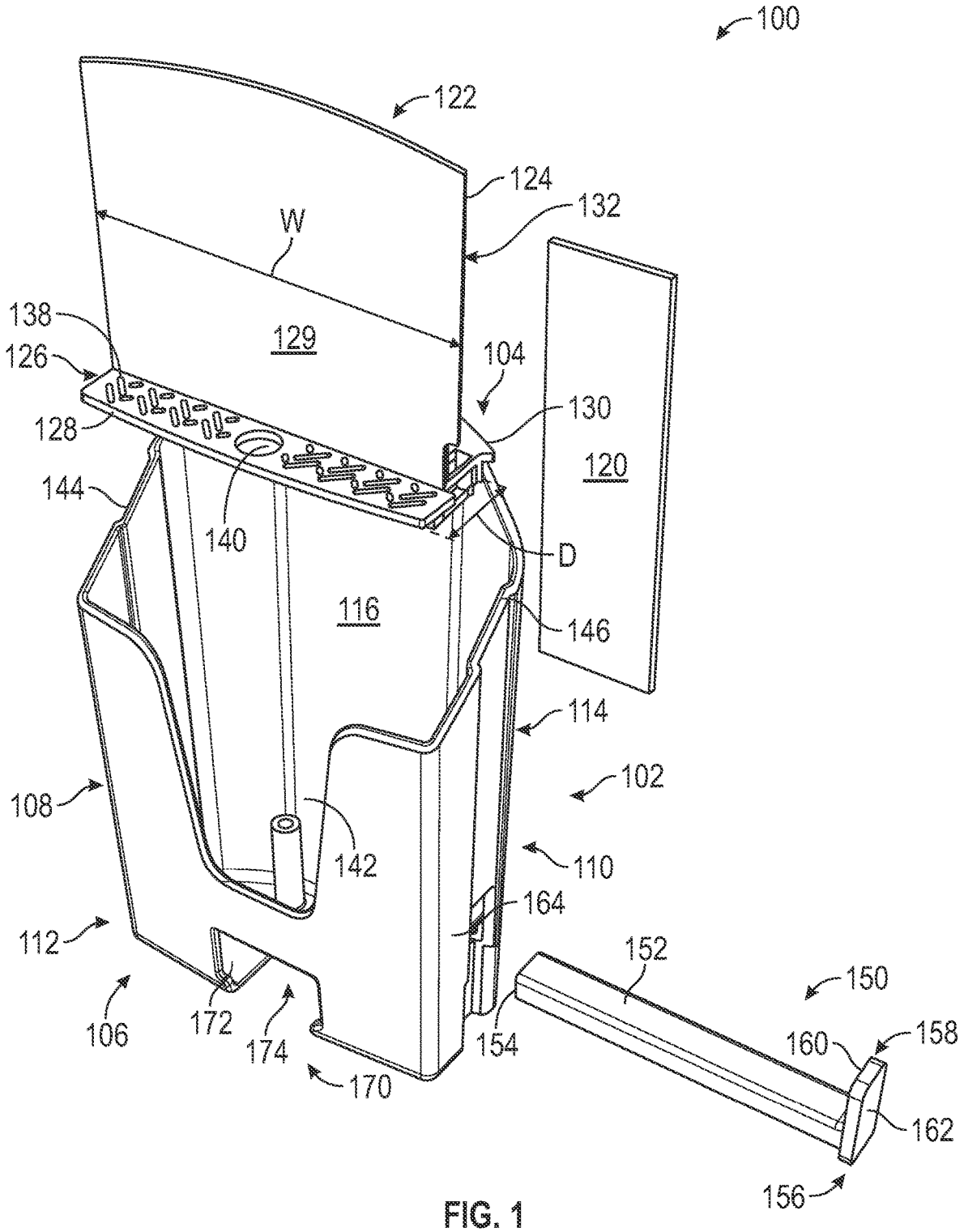
FIG. 1 is an exploded perspective view of one example implementation of a portable storage device made in accordance with the present disclosure.

FIG. 1 is an exploded perspective view of one example implementation of a portable storage device 100 made in accordance with the present disclosure. In the illustrated example, storage device 100 includes a housing 102 having a top end 104, a bottom end 106, opposed left side wall 108 and right side wall 110, front wall 112 and back wall 114 that define an interior volume 116 that can be used to form at least one storage compartment. Storage device 100 includes at least one attachment for releasably attaching the device to a structure. In the illustrated example, the at least one attachment includes a magnet 120 coupled to back wall 114 for magnetically attaching the storage device 100 to a structure, such as exercise equipment or locker at a gym.

In the illustrated example, storage device 100 includes a removeable divider 122 configured and dimensioned to be disposed in interior volume 116 and that includes a partition 124 and a base 126. A width, W, of divider 122 is substantially the same as a width of interior volume 116 and a depth, D, and outer shape of base 126 is substantially the same as a depth and shape of the interior volume. Base 126 includes a first portion 128 extending from a front side 129 of partition 124 and a second portion 130 extending from a rear side 132 of the partition. Front side 129 of partition 124, left wall 108, right wall 110 and first portion 128 define a first storage compartment 134 (See FIG. 3A) that is configured for storage of a mobile electronic device, such as a mobile phone but may also readily store other items in addition to or instead of a mobile phone or other mobile electronic device. Rear side 132 of partition 124, left wall 108, right wall 110 and second portion 128 of base 126 define a second storage compartment 136 (See FIG. 3A). In the illustrated example both the first and second storage compartments are rigid, e.g., they are defined by rigid walls. In other examples, one or more storage compartments of storage devices made in accordance with the present disclosure may be non-rigid, such as stretchable, deformable, elastic, or resiliently extendable, such as a storage device formed from a fabric pouch and/or one or more elastic bands.

In the illustrated example, first portion 128 forms a bottom wall of first storage compartment 134 and incudes a plurality of acoustic openings 138 (only one is labeled) to facilitate the transfer of sound to and from a mobile electronic device located in the first storage compartment 134 and a power cable opening 140 for routing a mobile electronic device power cable from an exterior location to the first storage compartment 134 for charging an electronic device located in the first storage compartment. Front wall 112 defines an opening 142 that is designed and configured to allow for at least a portion, and in the illustrated example, a substantial portion, e.g. greater than 50% or greater than 60% or greater than 70%, of a total area of a display screen of a mobile device located in first storage compartment 134 to be visible. Opening 142 facilitates easy access to first storage compartment 134 and the quick and easy storage and removal of a mobile device or other item therefrom and also facilitates use of the mobile device, such as viewing the screen during a video call or the viewing of pictures or videos on the device while the device is stored in the storage compartment. In the illustrated example there is no material, such as transparent plastic or glass material in the in the opening 142. In other examples, a transparent material may be located in the opening. In the illustrated example, top end 104 of housing 102 is truncated with a top end 144 of left wall 108 and a top end 146 of right wall 110 being inclined, resulting in a height H1, of first storage compartment 134 being lower than a height H2, of second storage compartment 136 (see FIG. 3E). The lower height, H1, results in first storage compartment 134 only surrounding a base portion or lower portion or lower half portion of a mobile device which can facilitate visibility of the screen of the mobile device and ease of storing and removing the device. In other examples, the lower height H1 may be achieved by a step-shaped top ends 144 and 146 of walls 108 and 110 (see, e.g., FIG. 6). In yet other examples, the height H1 of the first storage compartment may be the same or greater than the height H2 of the second storage compartment 136. In other examples, the storage device may only include one large storage compartment rather than two or may contain three or more storage compartments.

Storage device 100 also includes a retractable elongate member 150 slidably disposed in housing 102 and configured to move between a retracted position (e.g., the position of retractable elongate member 150 in FIG. 5A) in which the elongate member is disposed in the housing and an extended position (e.g., the position of retractable elongate member 150 in FIG. 4A) in which a portion of the elongate member extends from the housing to provide a structure for hanging a towel or other object from the storage device. In the illustrated example, retractable elongate member 150 includes a shaft 152 having first end 154 and second end 156 and a hook 158 disposed on the second end, the hook having a first side 160 and a second opposed side 162, wherein the second side of the hook is substantially flush with an outer surface 164 of right wall 110 of the housing 102 when the retractable elongate member is in the retracted position.

Portable storage device 100 also includes a bottle holder 170 located below first storage compartment 134 in a bottom portion of housing 102 for hanging a water bottle 402 from the storage device by a neck 404 of the water bottle (see FIGS. 4A and 4B), the bottle holder including a surface 172 configured to support the water bottle and an opening 174 in the surface configured to receive the neck 404 of the bottle.

Figure 2:
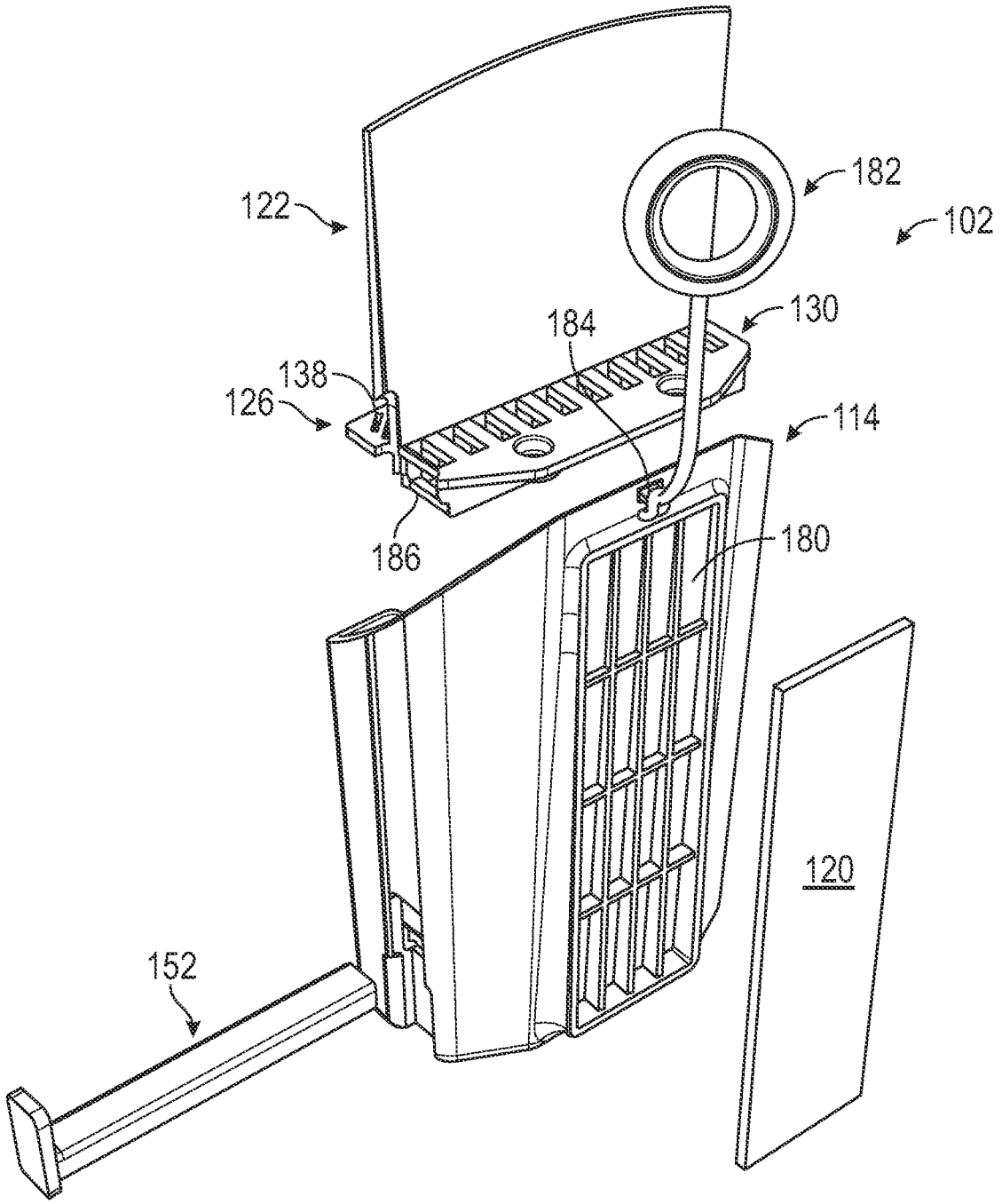
FIG. 2 is an exploded rear perspective view of the portable storage device of FIG. 1.

FIG. 2 is an exploded rear perspective view of portable storage device 100 and shows a magnet recess 180 located in back wall 114 where magnet 120 is seated. FIG. 2 also shows a second attachment that includes a lanyard 182 fixed to a lanyard opening 184 also located on back wall 114 for hanging the storage device 100 from any structure. As will be appreciated, lanyard 182 and magnet 120 and the specific location and configuration thereof are merely provided by way of example and any of a variety of attachments may be utilized for hanging or removably fixing storage device 100, such as additional or alternate magnets located on any side of the storage device, clamps, hooks, or any other attachment means known in the art.

In the illustrated example, divider 122 includes an elongate recess 186 located below second portion 130 of base 126 that shaft 152 of retractable elongate member 150 is configured to be slidably disposed in when the divider is installed in housing 102. In the illustrated example, recess 186 is located directly below second portion 130 of base 126 and is not located below first portion 128 of the base so that shaft 152 does not block acoustic openings 138 when retractable elongate member 150 is in the retracted position. In other examples, however, elongate recess 186 and shaft 152 may be located in any forward-rear location in housing, including a center location or partially or fully below first portion 128 of base 126.

Figure 3A:
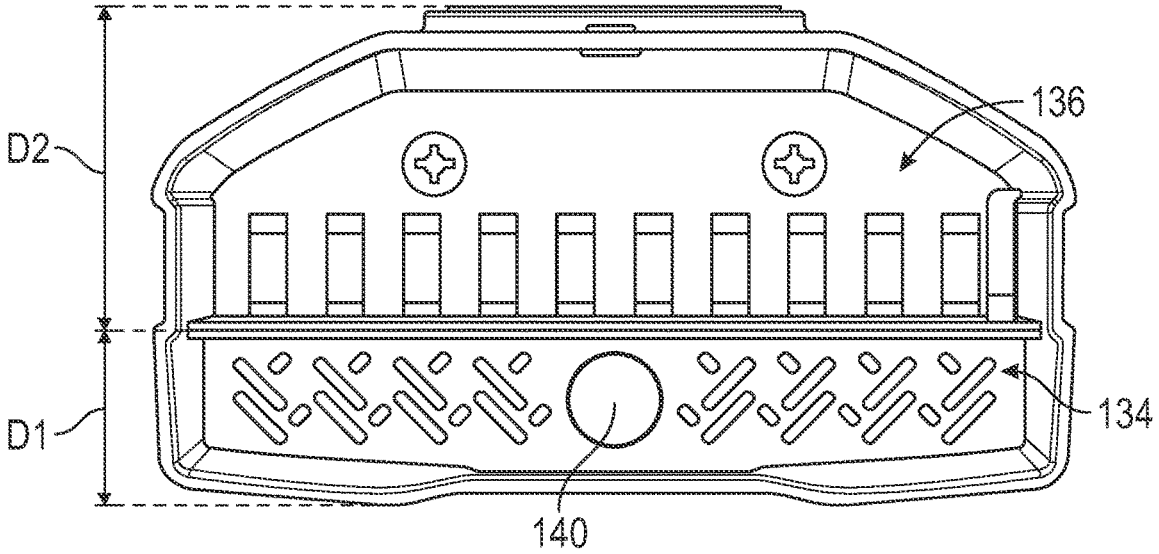
FIG. 3A is a top view of the storage device of FIGS. 1 and 2.
Figure 3B:
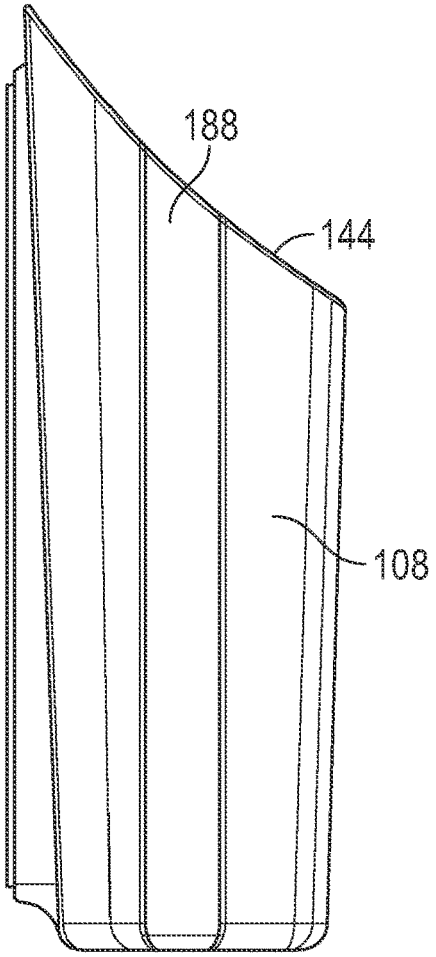
FIG. 3B is a right side view of the storage device of FIGS. 1 and 2.
Figure 3C:
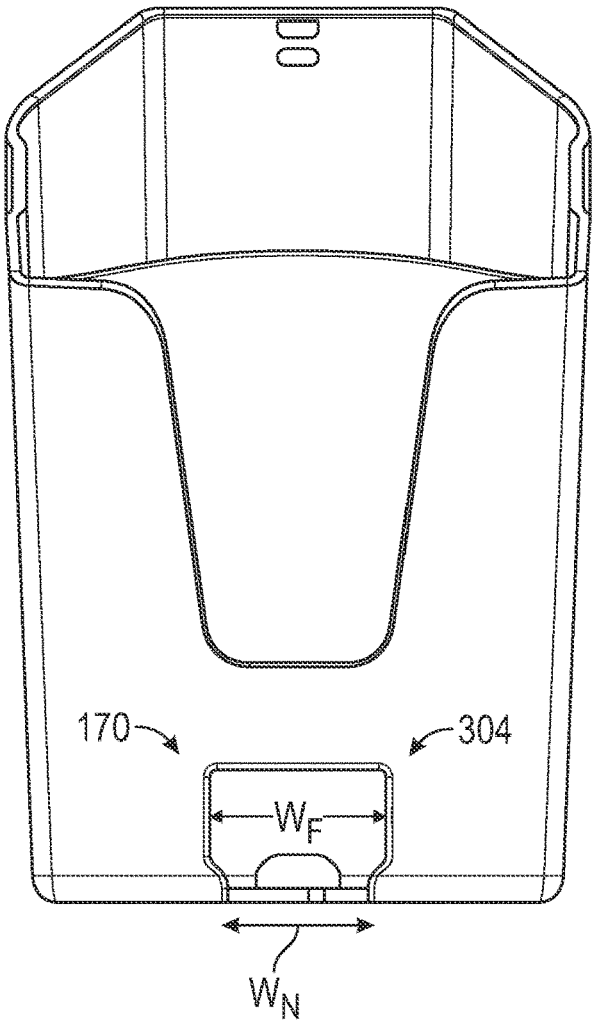
FIG. 3C is a front view of the storage device of FIGS. 1 and 2.
Figure 3D:
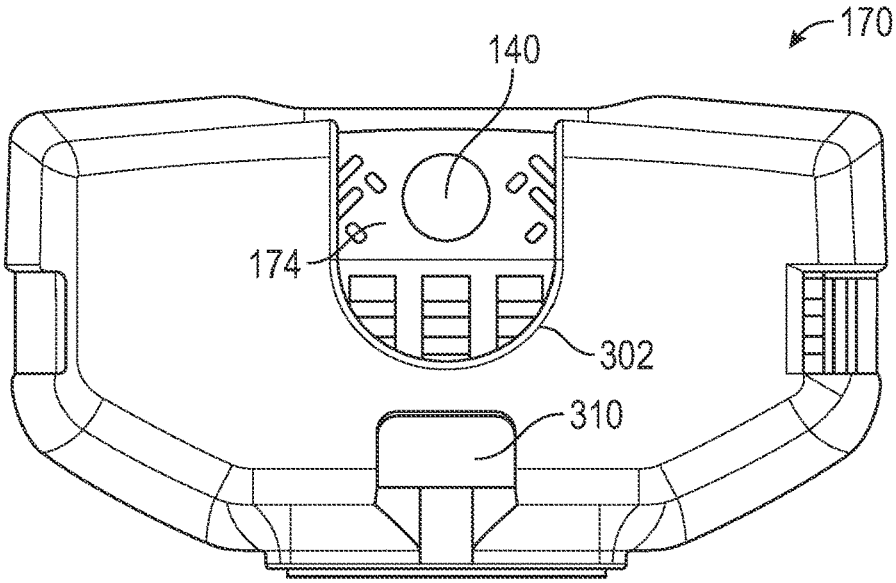
FIG. 3D is a bottom view of the storage device of FIGS. 1 and 2.
Figure 3E:
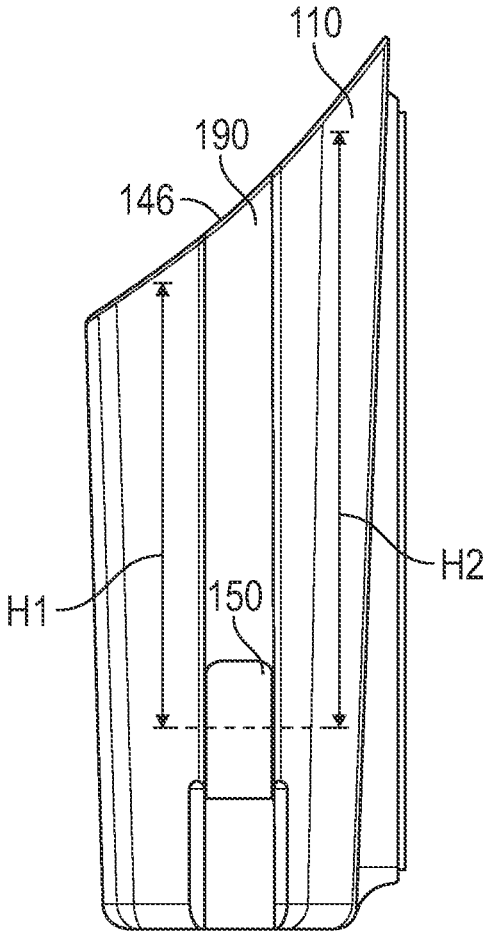
FIG. 3E is a left side view of the storage device of FIGS. 1 and 2.

FIGS. 3A to 3F show six orthogonal side views of portable storage device 100. Referring to FIG. 3A, in the illustrated example a depth D1 of first storage compartment 134 is less than a depth D2 of second storage compartment 136, with depth D1 being similar, e.g., within 10% or within 20% of a depth of a mobile electronic device, such as an iPhone® model released in 2020 or 2021 or a Samsung Galaxy model phone released in 2020 or 2021. As will be appreciated, the foregoing is provided by way of example only and depth D1 may be varied to accommodate any range of size of mobile electronic device, tablet, music player, or other personal item. A reduced depth D1 being similar to a depth of a phone facilitates holding the phone in a substantially upright position and maximizes the volume of second storage compartment 136. In other examples, however, depth D1 may be the same as or greater than depth D2. As shown in FIGS. 3B and 3E, left wall 108 and right wall 110 include contours for gripping the storage device, here elongate channels 188, 190.

Figure 4A:
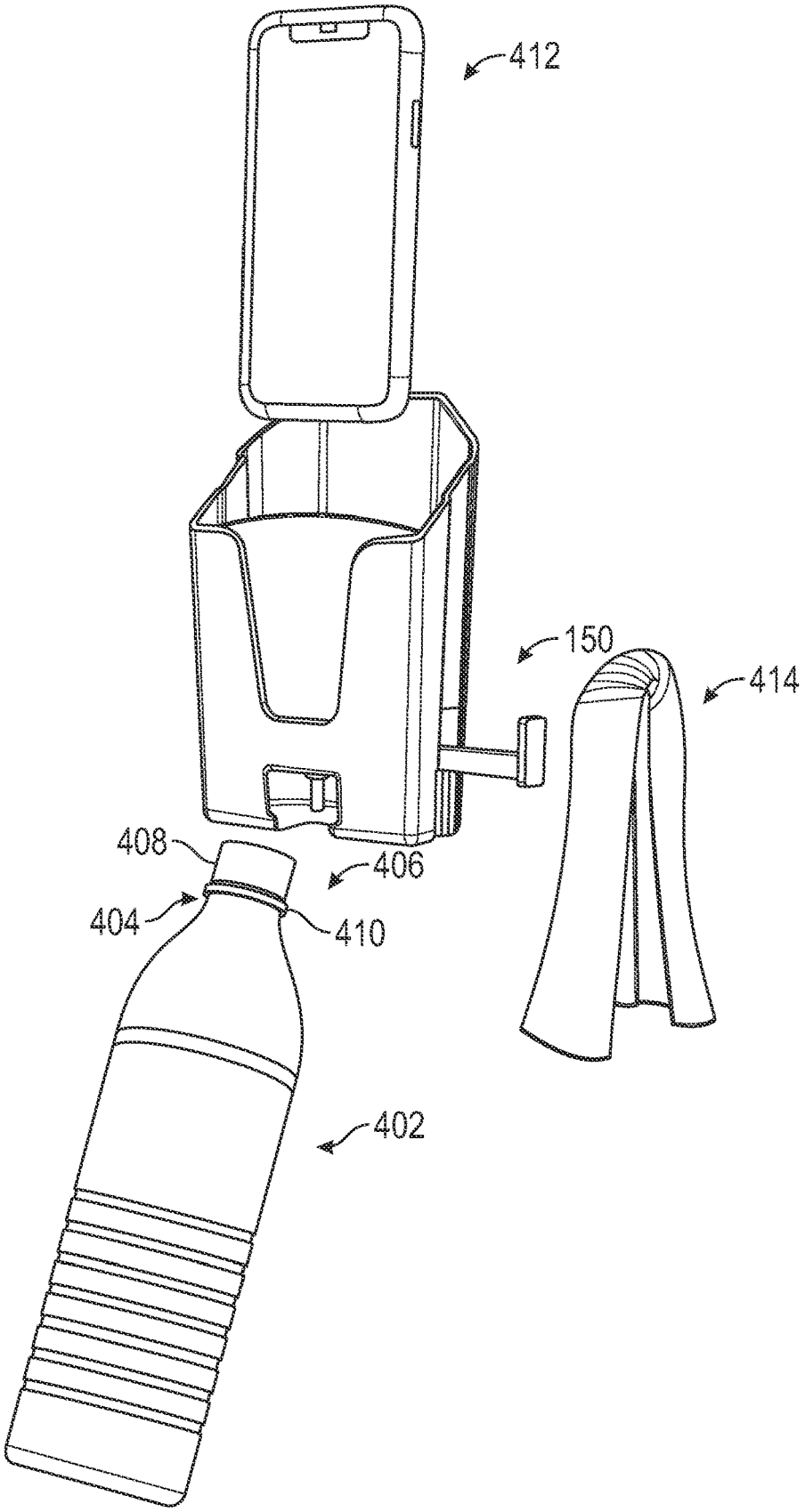
FIG. 4A is a perspective view of the portable storage device of FIGS. 1-3F showing example personal items that may be disposed in the storage device.

FIG. 3D, which is a bottom view of storage device 100, shows opening 174 in bottom end 106 of housing 102 that forms part of bottle holder 170. In the illustrated example, neck opening 174 has a curved or arcuate portion 302 that is sized, configured, and dimensioned to match a contour or radius of a neck of a bottle. Referring to FIG. 3C, front wall 112 includes a finish opening 304 that forms part of bottle holder 170 and that is configured and dimensioned to receive a finish portion and cap of a bottle, e.g., finish portion 406 and cap 408 of bottle 402 (FIG. 4A). Finish opening 304 has a width, $W_F$, that is greater than a width, $W_N$ of neck opening 174 to accommodate a width of a finish portion and cap of a water bottle. Width, $W_N$ of neck opening 174 is less than a width of a neck ring 410 and/or less than a width of cap 408 of bottle 402 such that when bottle 402 is inserted into bottle holder 170 neck ring 410 and/or a bottom surface of cap 408 rests on surface 172 of the bottle holder. Finish opening is located on front wall 112 of housing 102 and is configured and dimensioned to receive a finish portion and cap of a bottle and neck opening 174 is located in a bottle support wall of the housing 102 that is transverse to the front wall that is configured to receive a neck portion of a water bottle. In the illustrated example the bottle support wall is the bottom wall of housing 102 and a side of the support wall forms a bottom surface of the housing.

Figure 3F:
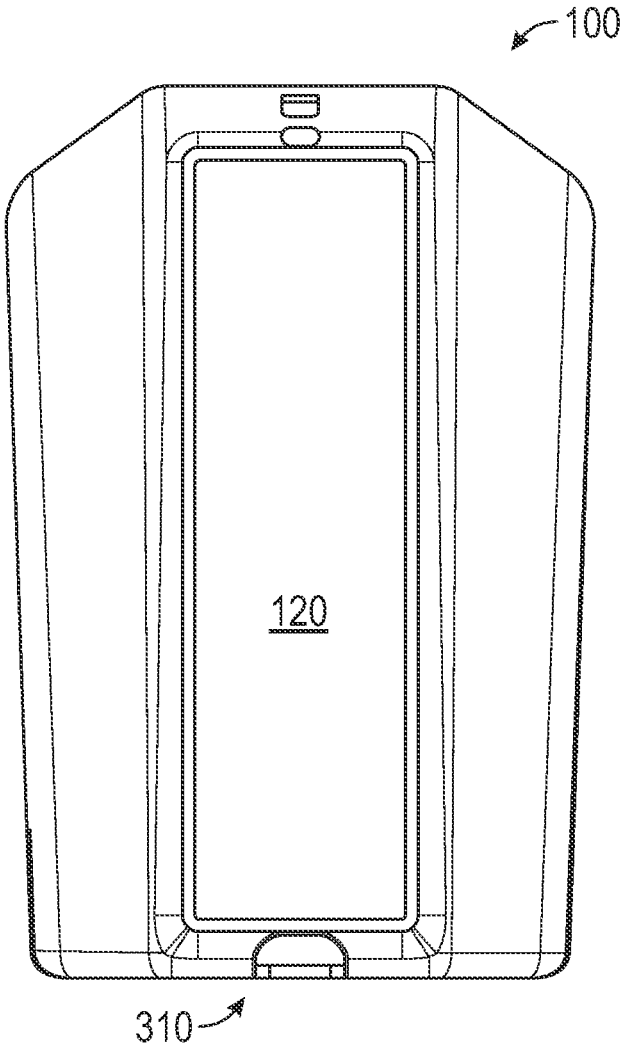
FIG. 3F is a rear view of the storage device of FIGS. 1 and 2.

As best seen in FIGS. 3C, 3D, and 3F, a second power cable opening 310 is formed in bottom end 106 and back wall 114 for routing a mobile electronic device power cable from an exterior location through the second power cable opening and first power cable opening 140 to first storage compartment 134 for connecting to an electronic device located therein.

Figure 4B:
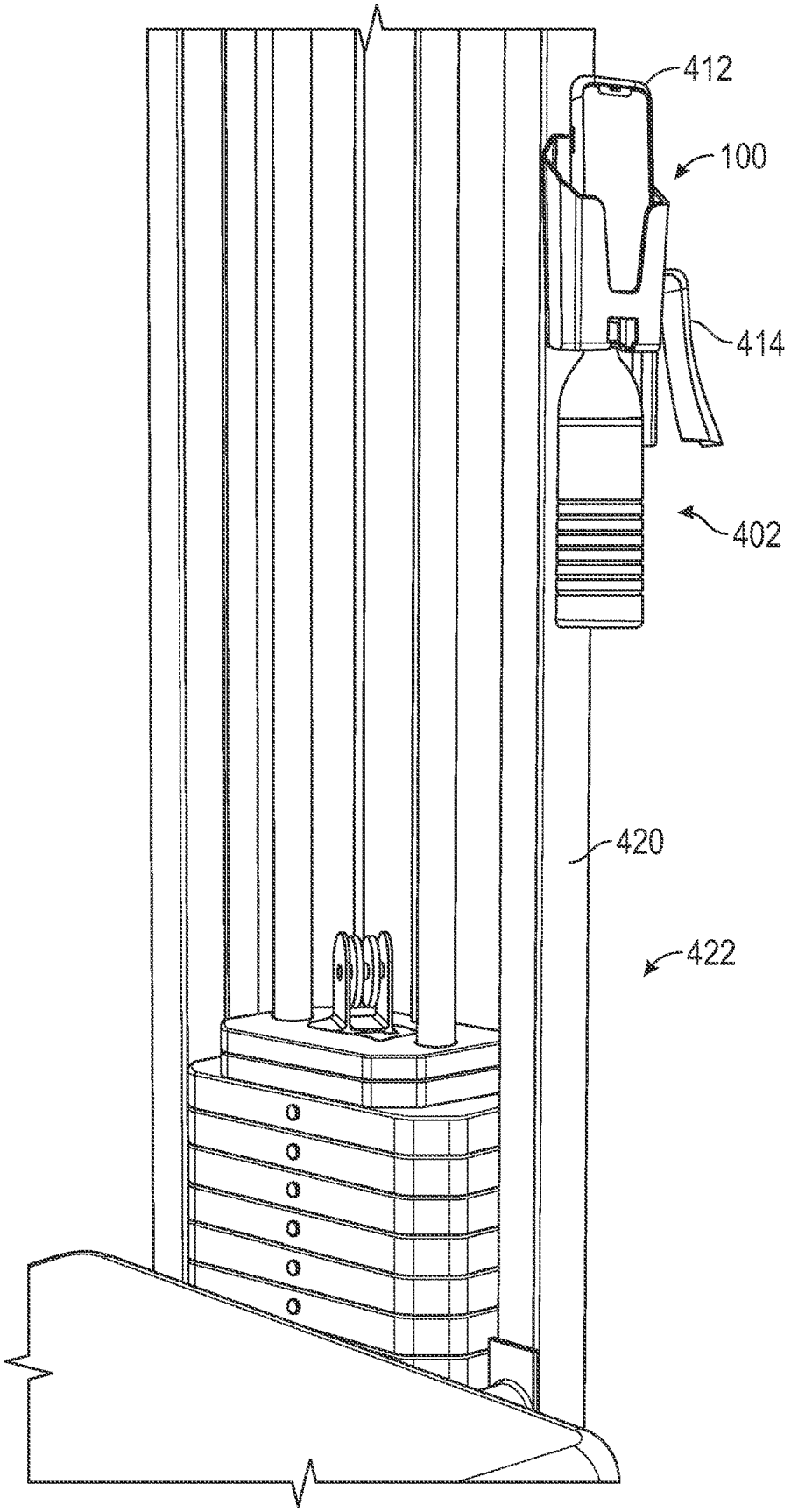
FIG. 4B is a perspective view of the portable storage device of FIGS. 1-3F in use, showing example personal items disposed in the storage device and the storage device removably attached to a structure.

FIGS. 4A and 4B are perspective views showing portable storage device 100 in use. FIG. 4A shows an example water bottle 402 that may be disposed in bottle holder 170 for hanging the water bottle from the storage device, an example mobile electronic device 412 that may be disposed in first or second storage compartment 134, 136, and example towel 414 that may be hung from retractable elongate member 150 when the retractable elongate member is in the extended position shown in FIG. 4A. FIG. 4B shows portable storage device 100 removeably magnetically attached by magnet 120 to a metal frame 420 of an exercise machine 422 typically found in a gym. As shown in FIG. 4B, portable storage device 100 can be quickly and easily attached to any magnetically compatible material or hung from any structure. In the attached position the storage device 100 acts as a repository for a plurality of personal items, such as mobile electronic device 412, bottle, 402, and towel 414, any one or more of the items can be removed and deposited while the storage device is attached. The entire assembly of storage device 100 and items disposed or coupled thereto can be detached from exercise equipment 422 and carried to another location, such as another piece of exercise equipment as a user moves around a gym performing an exercise routine, conveniently keeping all of the user's personal items in one location close at hand and off of any surfaces such as a floor or bench which can help prevent any contamination of any of the personal items.

Figure 5A:
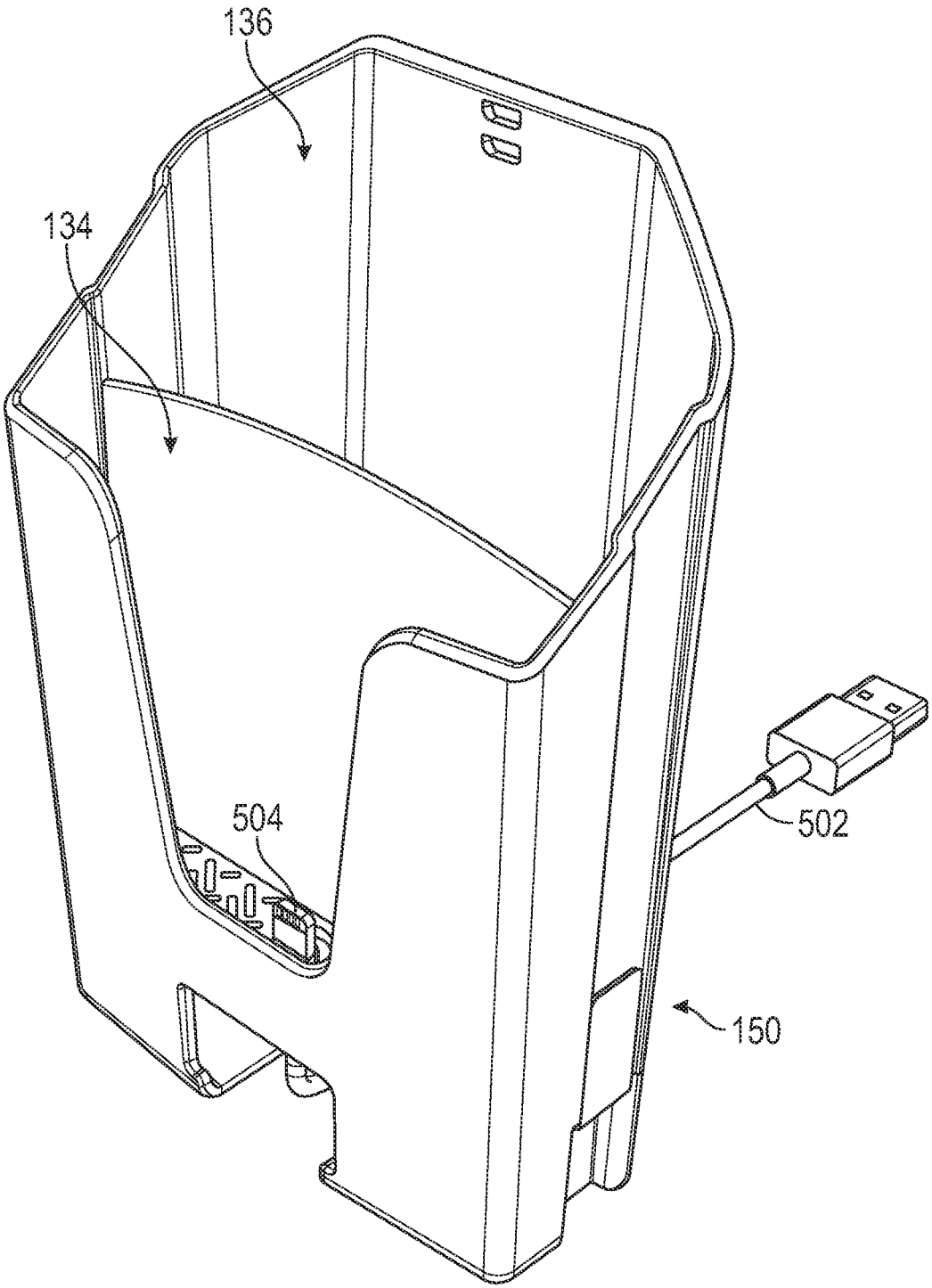
FIG. 5A is a front perspective view of the portable storage device of FIGS. 1-4B showing an electronic device charging cable disposed in the storage device.
Figure 5B:
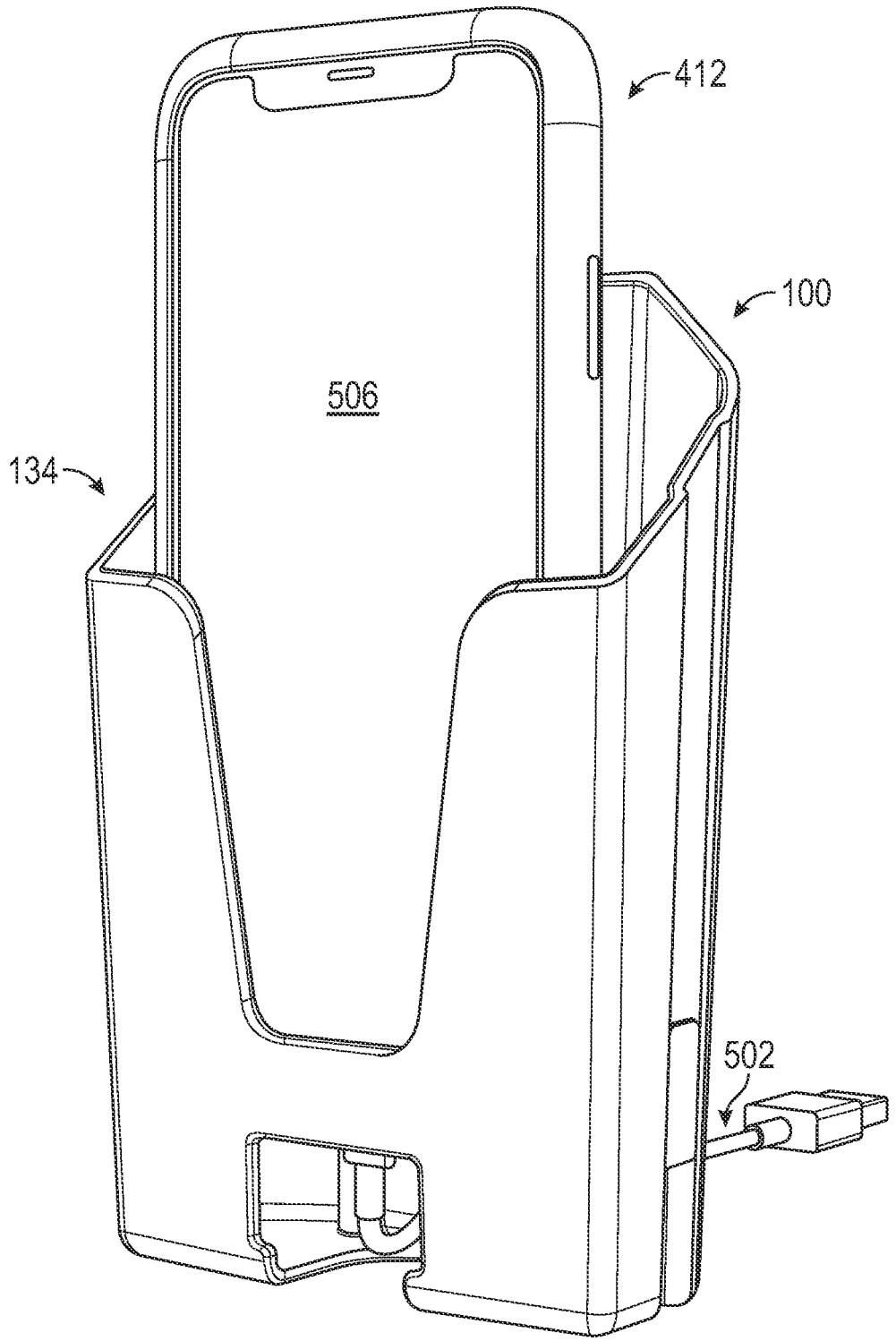
FIG. 5B is a front perspective view of the portable storage device of FIGS. 1-4B showing an electronic device charging cable and electronic device disposed in the storage device.

FIGS. 5A and 5B show storage device 100 with a mobile electronic device power cable 502 extending through first and second power cable openings 140 and 310 so that a first end 504 of the power cable can be located in first storage compartment 134 for connecting to mobile electronic device 412. FIG. 5B shows mobile electronic device 412 disposed in first storage compartment 134, with a majority of display screen 506 visible when the mobile electronic device is disposed in the first storage compartment due to opening 142 in front wall 112 and the relatively low height of walls 108 and 110 in the front portion of the storage device adjacent the first storage compartment.

Figure 6:
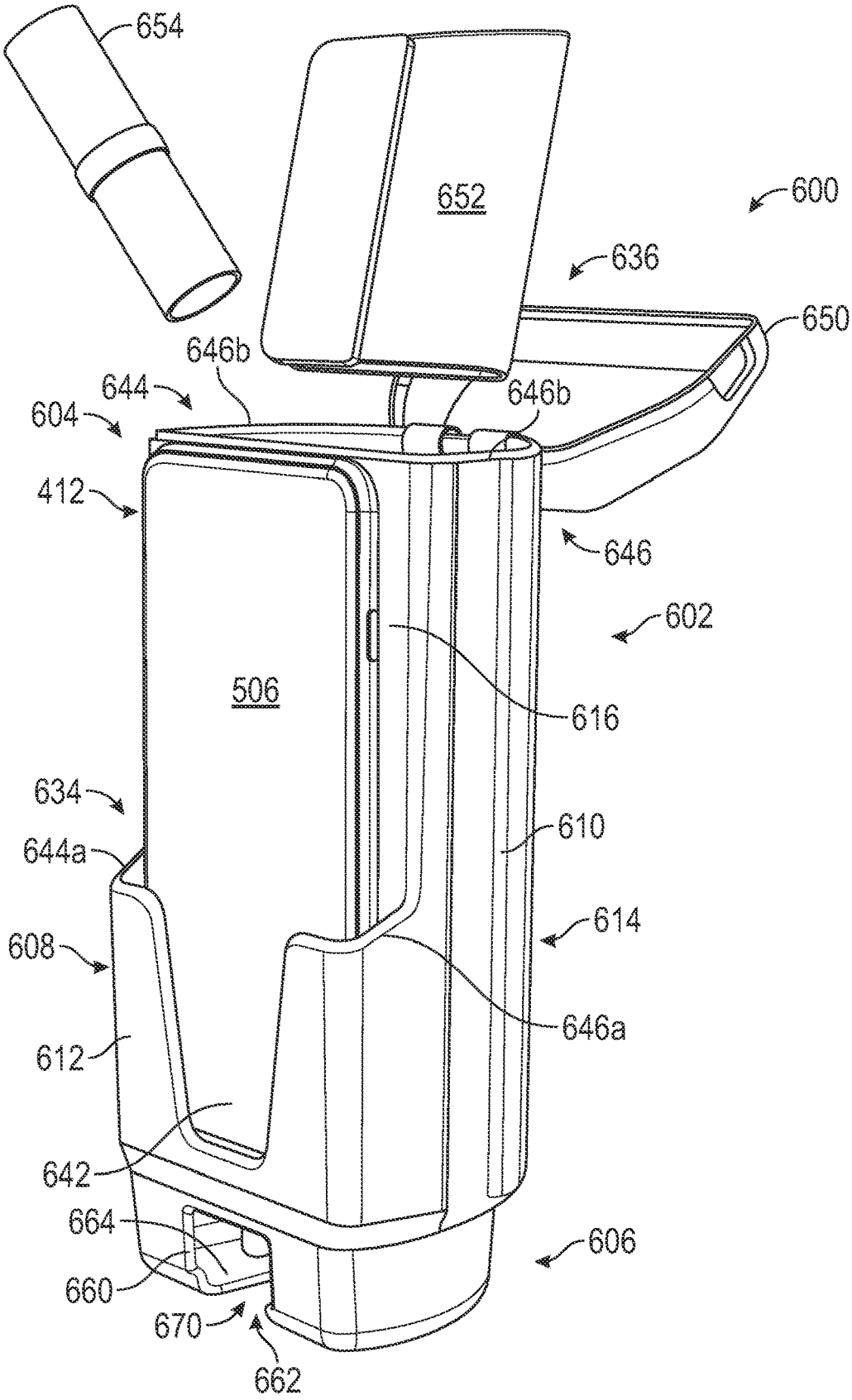
FIG. 6 is a front perspective view of another example implementation of a portable storage device made in accordance with the present disclosure.

FIG. 6 is a perspective view of another example implementation of a portable storage device 600 made in accordance with the present disclosure. Portable storage device 600 has a similar construction as portable storage device 100 and performs the same function of the storage of one or more personal items and the ability to removably secure the storage device to a structure, such as exercise equipment. Storage device 600 may have one or more magnets, lanyards, hooks, clamps or other attachment means for securing the storage device to the structure. In the illustrated example, storage device 600 includes a housing 602 having a top end 604, a bottom end 606, opposed left wall 608 and right wall 610, front wall 612 and back wall 614 that define one or more volumes that can be used to form at least one storage compartments. Walls 608 and 610 have top ends 644, 646 that generally have a step shape that include lower front portions 644*a*, 646*a*, and higher rear portions 644*b*, 646*b*.

Housing 602 also includes a partition 616. Front wall 612, partition 616, and front portions 644*a*, 646*a* of left and right walls 608, 610 form a first storage compartment 634 and back wall 614, partition 616, and rear portions 644*b*, 646*b* of the left and right walls form a second storage compartment 636. Similar to portable storage device 100, front wall 612 of portable storage device 600 includes an opening 642 that performs the same functions as opening 142 (FIG. 1), namely viewability of screen 506 of mobile device 412 and facilitating the easy storage and removal of the mobile device from the first storage compartment. Housing 602 also includes a lid 650 for closing and opening a top portion of second storage compartment 636. Second storage compartment 636 is designed and configured to securely hold one or more personal items, example items shown in FIG. 6 are a wallet 652 and lipstick 654. Storage device 600 also includes a bottle holder 670 located in bottom end 606 of housing 602 for hanging a bottle, e.g., bottle 402, from the storage device. In the illustrated example bottle holder 670 has substantially the same construction as bottle holder 170, including a finish opening 660 and a neck opening 662 and a surface 664 configured to support a neck ring or bottom end of a cap of a bottle disposed in the bottle holder 670.

Aspects of the present disclosure also include methods of using a portable storage device, wherein the portable storage device includes a housing having a first storage compartment capable of holding a mobile electronic device and a bottle holder located below the first storage compartment for hanging a water bottle from the storage device by a neck of the water bottle, the bottle holder including a finish opening located on a front wall of the housing that is configured and dimensioned to receive a finish portion and cap of a bottle and a neck opening located in a bottle support wall of the housing that is transverse to the front wall that is configured to receive a neck portion of a water bottle, wherein a neck ring, a bottom wall of a cap or another portion of the bottle is configured to come into contact with the bottle support wall and/or neck opening for supporting the bottle in a hanging position from the storage device. Wherein the method includes removeably attaching the portable storage device to a structure, such as exercise equipment, at an elevated location on the structure; and hanging a water bottle from the storage device by sliding the finish portion of the water bottle into the finish opening and hanging the water bottle from the bottle support wall.

In some examples, the method may also include placing a mobile electronic device in the first storage compartment and using the mobile electronic device while it is stored in the first storage compartment. In some examples, using the electronic device includes viewing an image on a screen of the device through an opening in a front wall of the storage device.

In some examples, the method may also include pulling a retractable elongate member slidably disposed in the housing from a retracted position to an extended position and hanging an object, such as a towel, from the a retractable elongate member while the storage device is attached to the elevated location on the structure.

The foregoing has been a detailed description of illustrative embodiments of the disclosure. It is noted that in the present specification and claims appended hereto, conjunctive language such as is used in the phrases "at least one of X, Y and Z" and "one or more of X, Y, and Z," unless specifically stated or indicated otherwise, shall be taken to mean that each item in the conjunctive list can be present in any number exclusive of every other item in the list or in any number in combination with any or all other item(s) in the conjunctive list, each of which may also be present in any number. Applying this general rule, the conjunctive phrases in the foregoing examples in which the conjunctive list consists of X, Y, and Z shall each encompass: one or more of X; one or more of Y; one or more of Z; one or more of X and one or more of Y; one or more of Y and one or more of Z; one or more of X and one or more of Z; and one or more of X, one or more of Y and one or more of Z.

Various modifications and additions can be made without departing from the spirit and scope of this disclosure. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present disclosure. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this disclosure.

Exemplary embodiments have been disclosed above and illustrated in the accompanying drawings. It will be understood by those skilled in the art that various changes, omissions and additions may be made to that which is specifically disclosed herein without departing from the spirit and scope of the present disclosure.

What is claimed is:

1. A portable storage device, comprising:

a housing that includes:

a first storage compartment capable of holding a mobile electronic device;

a bottle holder located below the first storage compartment for hanging a water bottle from the storage device by a neck of the water bottle, the bottle holder including a surface configured to support the water bottle and an opening in the surface configured to receive a neck of the bottle; and an attachment disposed on the housing for removeably coupling the storage device to a structure; and further comprising a retractable elongate member slidably disposed in the housing and configured to move between a retracted position in which the elongate member is disposed in the housing and an extended position in which a portion of the elongate member extends from the housing to provide a structure for hanging a towel or other object from the storage device.

2. The storage device of claim 1, wherein the first storage compartment is defined by rigid walls.

3. The storage device of claim 1, wherein the first storage compartment is defined at least in part by a bottom wall that includes acoustic openings to facilitate the transfer of sound to and from a mobile electronic device located in the first storage compartment.

4. The storage device of claim 1, wherein the first storage compartment is defined at least in part by a bottom wall, wherein the bottle holder is located below the bottom wall, the surface of the bottle holder and the bottom wall defining a volume configured to receive a finish portion of the water bottle.

5. The storage device of claim 1, wherein the retractable elongate member includes a shaft having first and second ends and a hook disposed on the second end, the hook having first and second opposed sides, wherein the second side of the hook is substantially flush with an outer wall of the housing when the retractable elongate member is in the retracted position.

6. The storage device of claim 1, wherein the first storage compartment is defined at least in part by a bottom wall that includes acoustic openings to facilitate the transfer of sound to and from a mobile electronic device located in the first storage compartment, wherein the retractable elongate member is slidably disposed in a volume within the housing that is located behind the first storage compartment so that the elongate member does not block the acoustic openings when it is in the retracted position.

7. The storage device of claim 6, wherein the housing further includes a second storage compartment located behind the first storage compartment and above the volume the retractable elongate member is slidably disposed in.

8. The storage device of claim 1, wherein a bottom surface of the first storage compartment and a back wall of the housing include openings for routing mobile electronic device power cable from an exterior location to the first storage compartment for charging a mobile electronic device located in the first storage compartment.

9. The storage device of claim 1, wherein the attachment is one or more of a magnet, a lanyard, a hook, or a clamp.

10. A portable storage device, comprising:

a housing;

a retractable elongate member slidably disposed in the housing and configured to move between a retracted position in which the elongate member is disposed in the housing and an extended position in which a portion of the elongate member extends from the housing to provide a structure for hanging a towel or other object from the storage device;

a bottle holder located in a bottom portion of the housing for hanging a bottle from the storage device by a neck of the bottle, the bottle holder including a surface configured to support the bottle and an opening in the surface configured to receive a neck of the bottle; and an attachment disposed on the housing for removeably coupling the storage device to a structure.

11. A method of using a portable storage device that includes a housing and a bottle holder, the method comprising:

removeably attaching the portable storage device to a structure at an above ground elevated location on the structure; and hanging a water bottle from the storage device by sliding a finish portion of the water bottle into a finish opening located on a front wall of the housing and hanging the water bottle from a bottle support wall of the housing that is transverse to the front wall; and further comprising placing a mobile electronic device in a storage compartment of the housing and using the mobile electronic device while it is stored in the storage compartment.

12. The method of claim 11, wherein using the mobile electronic device includes viewing an image on a screen of the mobile electronic device through an opening in a front wall of the storage device.

13. The method of claim 11, further comprising:

pulling a retractable elongate member that is slidably disposed in the housing from a retracted position to an extended position; and hanging a towel from the a retractable elongate member while the storage device is attached to the structure at the elevated location.

* * * * *